US007128633B2

(12) United States Patent
Wilson

(10) Patent No.: US 7,128,633 B2
(45) Date of Patent: Oct. 31, 2006

(54) MECHANICAL ARM

(76) Inventor: Eric Steven Wilson, 4357 Peaceful Pl., Langley, WA (US) 98260

( * ) Notice: Subject to any disclaimer, the term of this patent is extended or adjusted under 35 U.S.C. 154(b) by 0 days.

(21) Appl. No.: 10/898,434

(22) Filed: Jul. 23, 2004

(65) Prior Publication Data

US 2005/0053453 A1 Mar. 10, 2005

Related U.S. Application Data

(60) Provisional application No. 60/490,071, filed on Jul. 24, 2003.

(51) Int. Cl.
*A63H 17/12* (2006.01)

(52) U.S. Cl. ..... 446/425; 414/680; 414/915; 446/427

(58) Field of Classification Search ..... 414/729, 414/719, 680, 915; 901/15, 21; 446/424–428; 74/490.04

See application file for complete search history.

(56) References Cited

U.S. PATENT DOCUMENTS 2,822,641 A * 2/1958 Lamb ..... 446/426
2,985,983 A * 5/1961 Konstenius ..... 446/426
3,587,872 A 6/1971 Pauly
4,863,164 A 9/1989 Mizunuma

* cited by examiner

*Primary Examiner*—Donald Underwood

(57) ABSTRACT

A mechanical arm generally intended for use as a toy or game element comprises a base rotatably supporting a turret. A first link connected to the turret by a shoulder joint, a second link connected to the first link by an elbow joint, and an end effector connected to the distal end of the second link. A first lever with a handgrip drives the first link, a second lever with a handgrip drives the second link using a drive cable and pulleys mounted in the interior of the first link. The end effector is controlled by a lever attached near the second handgrip. A control cable is threaded through the hollow interior of the mechanical arm to operate the end effector.

18 Claims, 7 Drawing Sheets

MECHANICAL ARM

CROSS-REFERENCE TO RELATED APPLICATIONS

This application claims the benefit of Provisional Patent Application Ser. No. 60/490,071, filed Jul. 24, 2003.

BACKGROUND OF THE INVENTION

The present invention relates to a mechanical arm having an end effector mounted at the remote end of the mechanical arm and, more specifically, to a toy or a game which involves picking up objects.

Small mechanical arms or robot arms used as a toy or game element have been known for some time. Frequently electric motors and gears are used to operate the mechanical arm. Thus they tend to be slow, noisy, complicated, require an electrical power source, and the operator does not receive end effector feedback from the controls.

Linkages have been used as elements of robot arms and their disadvantages may comprise the following: force applied by arm drive means to mechanical arm greatly varies over the range of motion, and the linkages cause dangerous pinch points for fingers.

Sheathed control cables have been used in mechanical arms to bypass the articulated arm joints and their disadvantages may include the following: unsecured cable housing allows play in the control cable, they create dangerous pinch points, and cable housing may become kinked or tangled.

Simple mechanical arms have been used such as U.S. Pat. No. 4,863,164 and their disadvantages may comprise the following: limited range of movement, can not be used for a variety of games and activities.

BRIEF SUMMARY OF THE INVENTION

In a preferred embodiment, a mechanical arm comprises a turret rotatably mounted to a base for rotation about a vertical axis. The proximal end of a first link is rotatably mounted to the turret for rotation about a horizontal axis. A first lever is rigidly mounted to the proximal end of the first link. A second link is rotatably mounted to the distal end of the first link for rotation about a horizontal axis. A second lever is rotatably mounted to the proximal end of the first link. A drive cable coupling the second handle to the second link. An end effector lever is slidably mounted near the second handgrip. An end effector is mounted to the distal end of the second link and an end effector cable is threaded through the hollow interior of the mechanical arm connecting the end effector lever and the end effector.

DETAILED DESCRIPTION OF THE INVENTION

Figure 1:
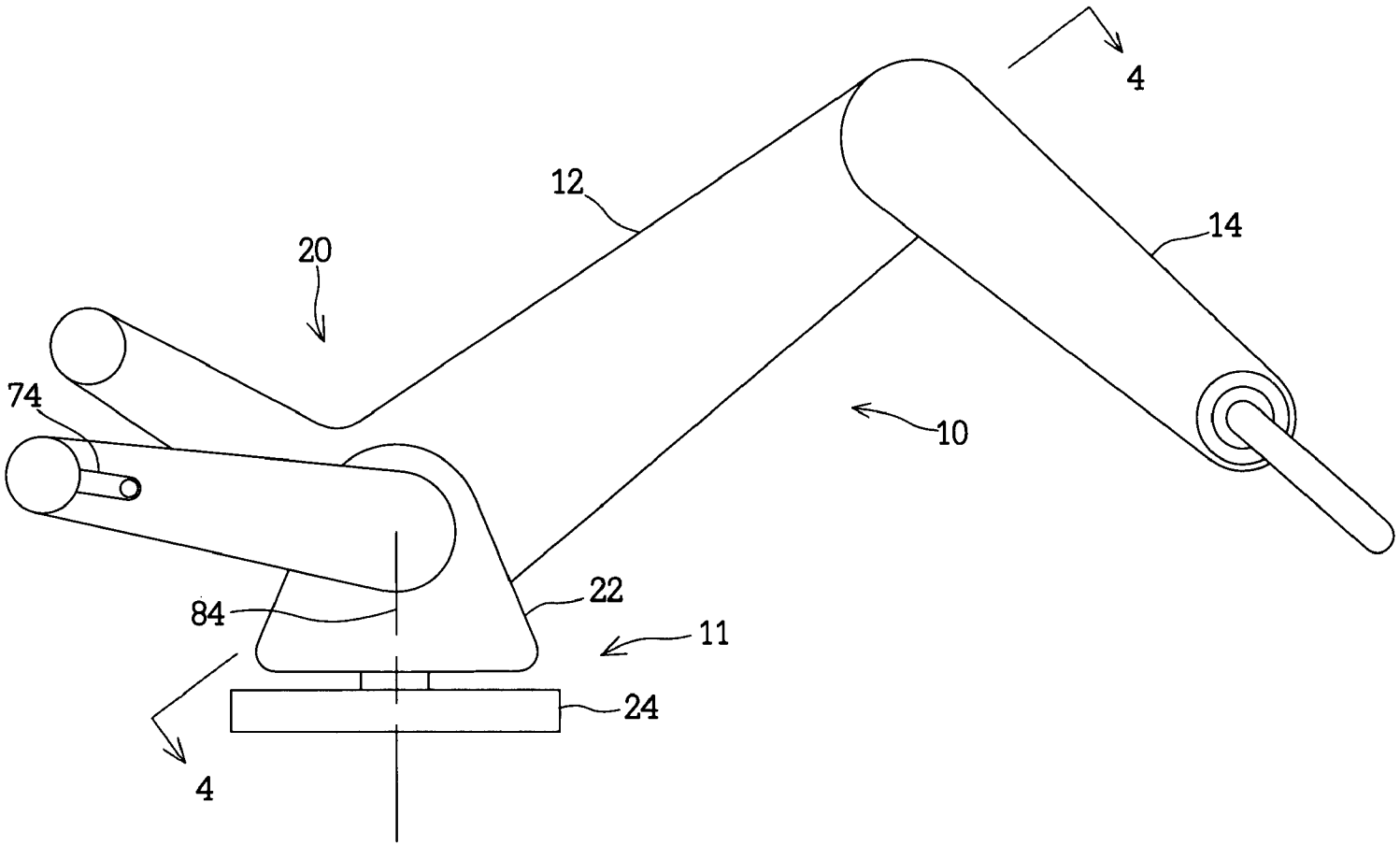
FIG. 1 shows the right side view of the mechanical arm.
Figure 2:
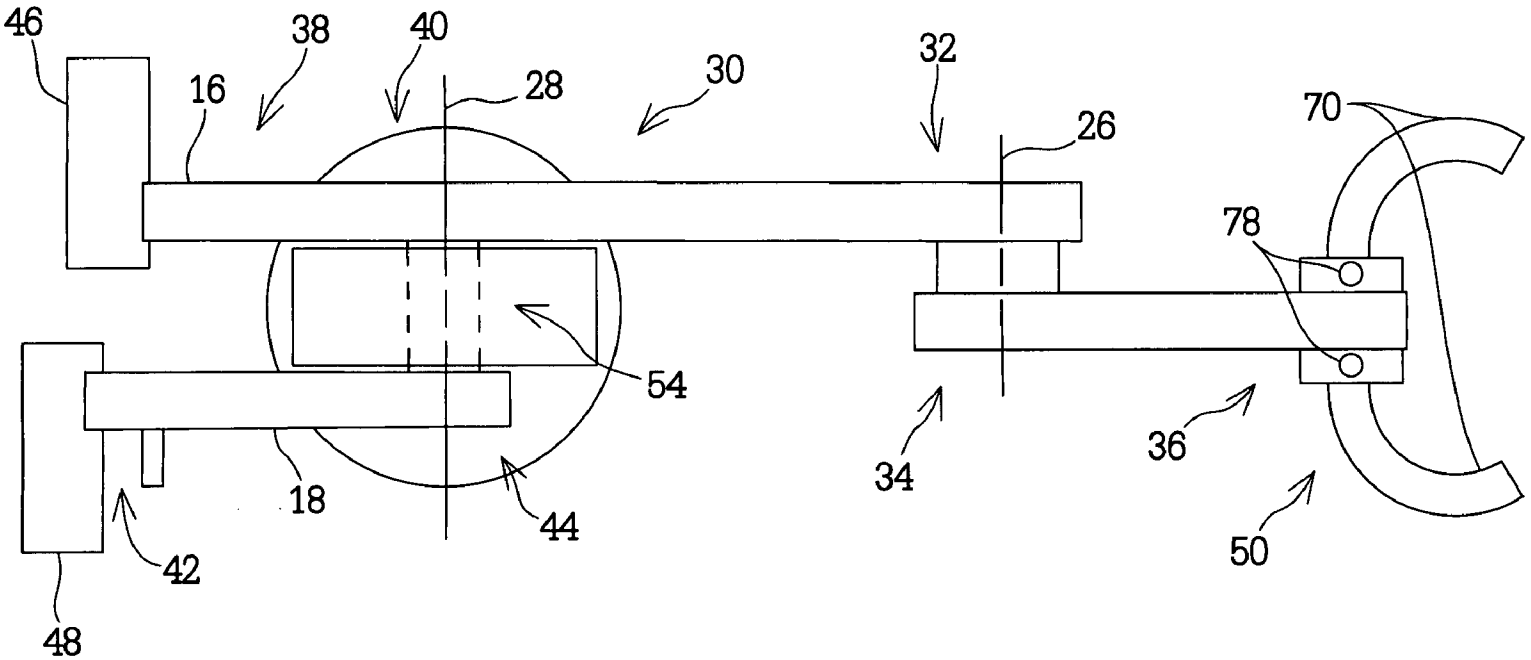
FIG. 2 shows the top view of the mechanical arm.
Figure 3:
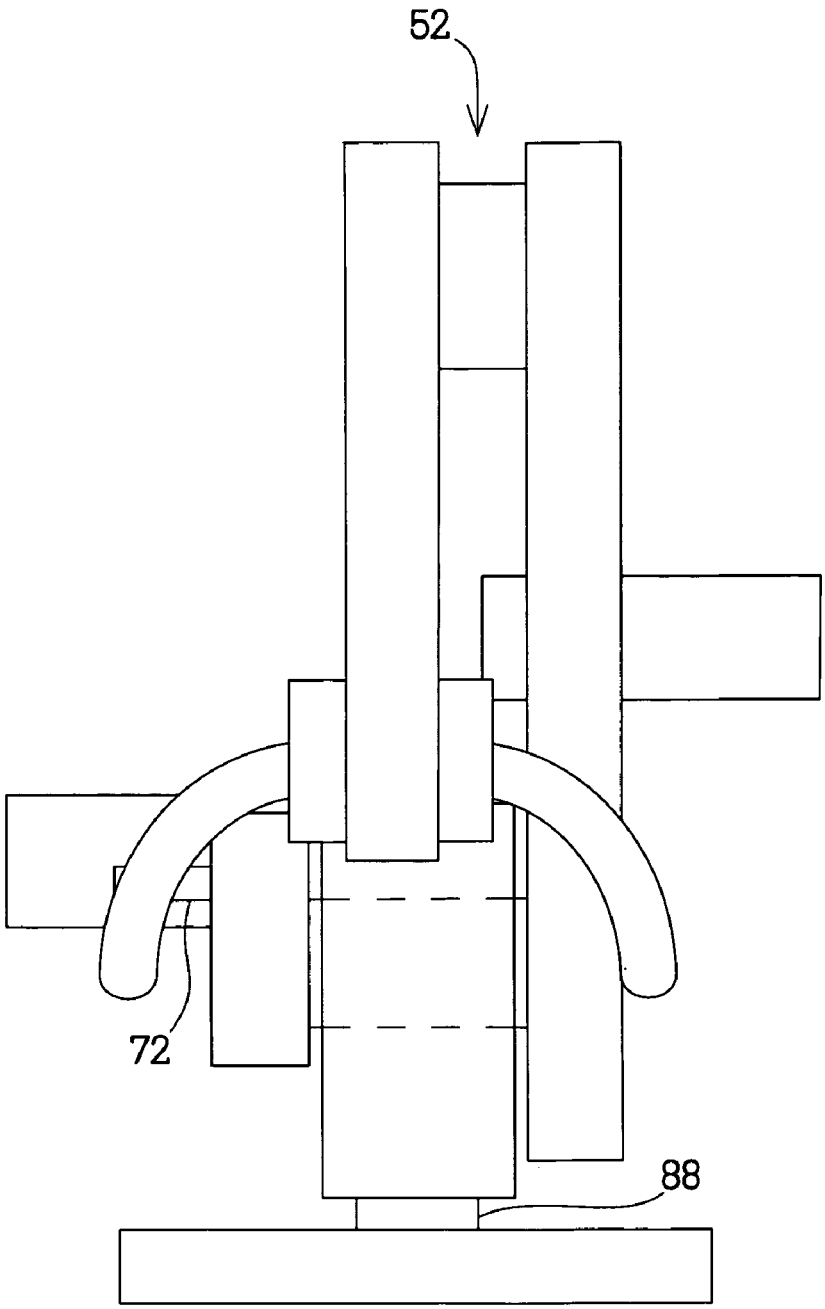
FIG. 3 shows the front view of the mechanical arm.

As shown FIG. 1-3, a mechanical arm 10, and support means 11, includes a base 24 which is generally round and has a flat lower surface for supporting the mechanical arm 10 on a table top, floor, or other suitable structure. A turret 22 is mounted to the base 24 for rotation relative to the base 24 about a vertical pivot axis 84 of a base pivot joint 88. A first link 12 has a distal end 32 and a proximal end 30 and is preferably hollow. First link 12 is mounted to the turret 22 for rotation relative to the turret 22 about a second pivot axis 28 of a second joint 54 at the proximal end of the first link 12.

Figure 4:
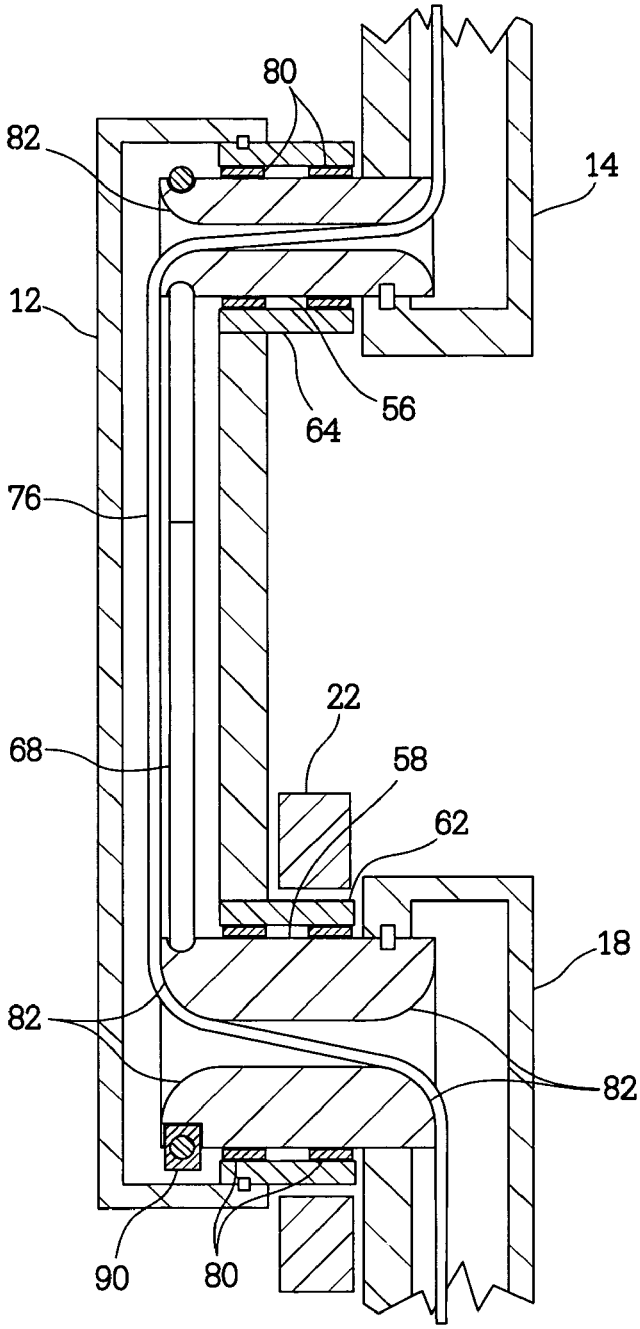
FIG. 4 shows a cross section of the first link components.

As illustrated in FIG. 4, the first link 12 is carried at its proximal end by a second cylindrical sleeve 62 which extends at a right angle relative to the longitudinal axis of the first link 12. A first lever 16 has a distal end 40, a proximal end 38, and a longitudinal axis. The distal end of the first lever 16 is rigidly connected to the proximal end of the first link 12. The longitudinal axis of the first lever 16 is at a right angle relative to the second pivot axis 28. A first handgrip 46 has a longitudinal axis. The handgrip 46 is rigidly connected to the proximal end of the first lever 16 with its longitudinal axis parallel to the second pivot axis 28.

Figure 5:
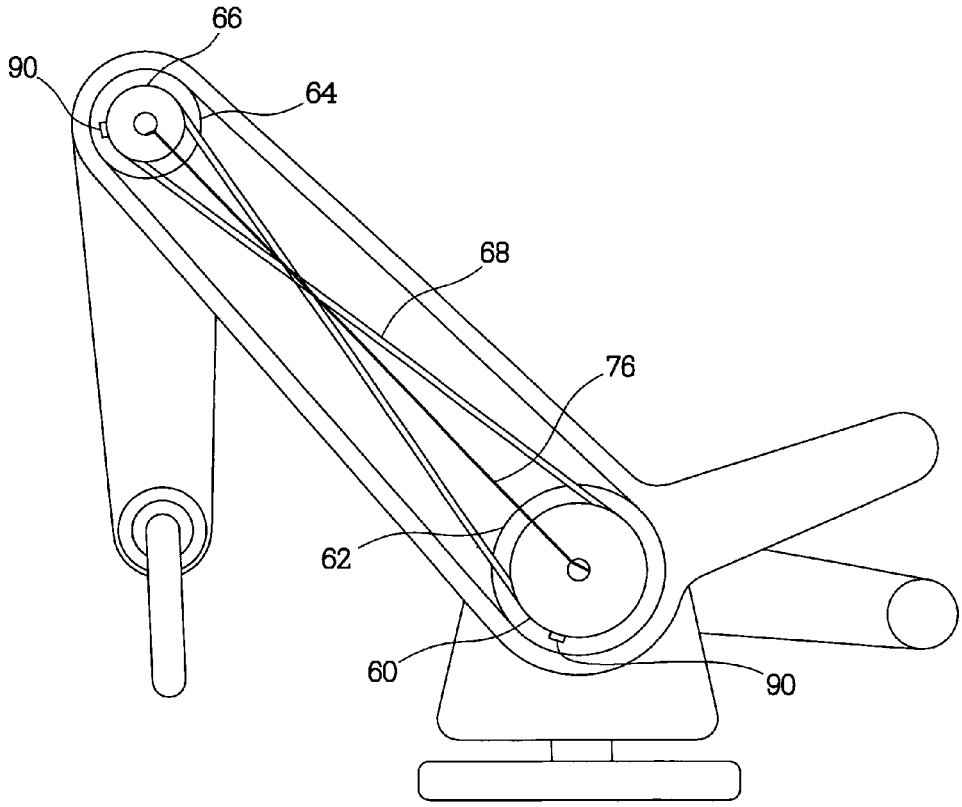
FIG. 5 shows a left side view with first link components exposed.

A second lever 18 has a distal end 44, a proximal end 42, a longitudinal axis, and is hollow. The second lever 18 is carried at its distal end by a second hollow shaft 58 which extends at a right angle relative to the longitudinal axis of the second lever 18. As shown in FIG. 5, a second pulley 60 is concentric with the second shaft 58 and rigidly connected to the end of the second shaft 58. A second handgrip 48 has a longitudinal axis. The handgrip is rigidly connected to the proximal end of the second lever 18 with its longitudinal axis parallel to the second pivot axis 28. The second shaft 58 is concentrically carried by bushings 80 in the second cylindrical sleeve 62. The first link 12 and the second lever 18 are able to rotate with respect to each other about the second pivot axis 28. A horizontal force parallel to the second pivot axis 28 and applied to the handgrips will rotate the mechanical arm 10 about the vertical pivot axis 84.

A second link 14 has a proximal end 34 and a distal end 36 and is preferably hollow. Second link 14 is mounted to the distal end of the first link 12 for rotation relative to the first link 12 about a first pivot axis 26 of a first joint 52 at the distal end of the first link 12. The first link 12 has a first cylindrical sleeve 64 which extends at a right angle relative to the longitudinal axis of the first link 12. The second link 14 is carried at its proximal end by a first hollow shaft 56 which extends at a right angle relative to the longitudinal axis of the second link 14. A first pulley 66 is concentric with the first shaft 56 and rigidly connected to the end of the first shaft 56. The first shaft 56 is concentrically carried by bushings 80 in the first cylindrical sleeve 64. The first link 12 and the second link 14 are able to rotate with respect to each other about the first pivot axis 26.

As best shown in FIG. 5, a drive cable 68 engaging the circumferential surface of the first pulley 66 and the circumferential surface of the second pulley 60. The drive cable 68 has at least one tooth (90) which mates with the circumferential surface of the first pulley 66 and at least one tooth (90) which mates with the circumferential surface of the second pulley 60. The ends of the drive cable are joined together to form a continuous loop. The drive cable 68 crosses upon itself while traversing the space between the first pulley 66 and the second pulley 60. Thus a clockwise rotation of the second handgrip 48 about the second pivot axis 28 rotates the second link 14 conterclockwise about the first pivot axis 26. The amount of movement of the second link 14 relative to the first link 12 depends on the ratio of the diameters of the first pulley 66 and the second pulley 60. The drive cable 68 is housed completely within the interior of the first link 12.

As shown in FIG. 1-3, an end effector 50 includes two jaws 70. Each jaw 70 is pivotally mounted on the distal end of the second link 14. A jaw closing lever 72 is linearly movable within a slot 74 at the proximal end of the second lever 18. The jaw closing lever 72 is biased into an open position (away from the hand grip 48) with two springs 78 held in a distal portion of the second link 14 such that the jaws 70 are in an open configuration when no manual force is applied against the force of the springs 78 to move the jaw closing lever 72 toward the hand grip 48. An end effector cable 76 is threaded through and housed completely within the interiors of the second lever 18, and the first and second links 12 and 14. The end effector cable 76 axially traverses the first and second joints 52 and 54 by resting on inward curving surfaces 82 at each end of the first shaft 56 and also the second shaft 58 which allow the end effector cable 76 to slide radially as the first and second links 12 and 14 and second lever 18 rotate, and also to slide axially as the end effector lever 72 is operated. The length of the cable's path through the first and second joints 52 and 54 remains nearly constant since the end effector cable 76 is held near the longitudinal axes of the joints 52 and 54.

Figure 6:
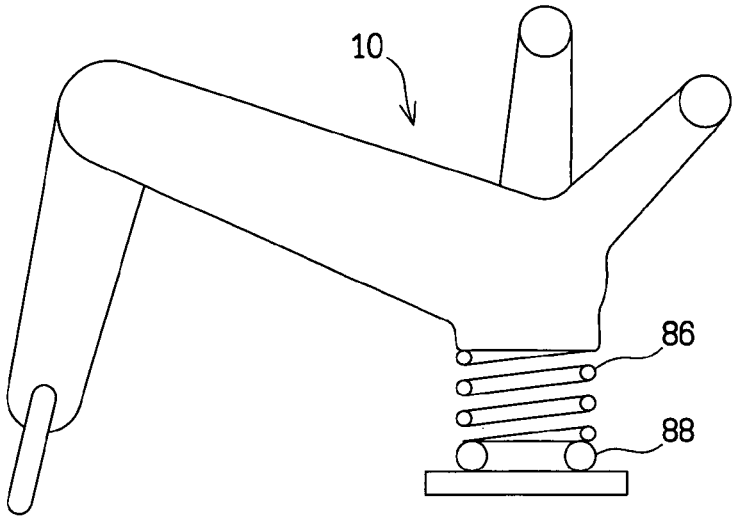
FIG. 6 shows the mechanical arm mounted to a support means comprising a spring and a base.

An additional embodiment as illustrated in FIG. 6, includes one or more springs 86 or flexible elements rigidly attached to the base pivot 88 and rigidly attached to the arm assembly 20, in place of the turret 22, to allow the arm assembly 20 an additional degree of rotational freedom about a horizontal axis.

Figure 7:
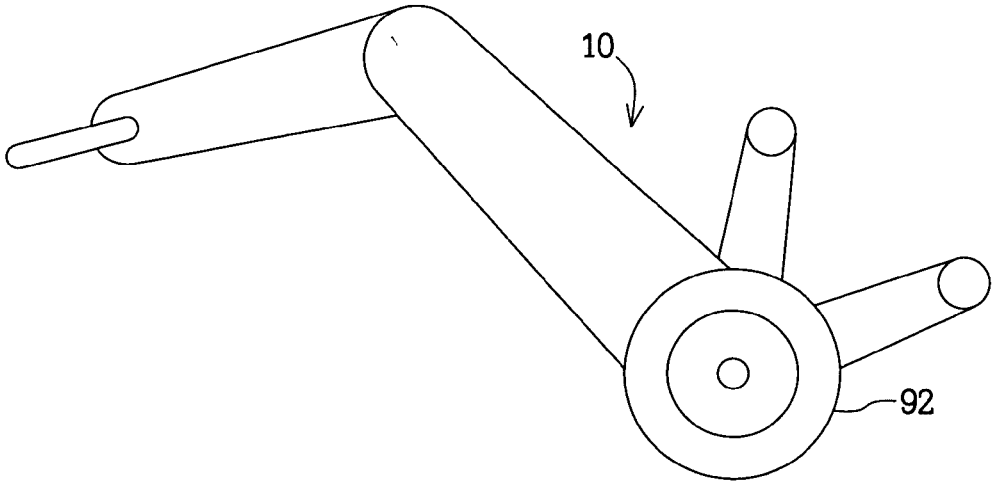
FIG. 7 shows the mechanical arm mounted to a support means having wheels.

As shown in FIG. 7, an additional embodiment includes two wheels 92 rotatably mounted on each side of the arm assembly 20 with the axis of rotation of the wheels 92 parallel to the second pivot axis 28. The wheels 92 used in place of the turret 22, the base 24, and the base pivot joint 88 to allow the arm to pivot vertically about the horizontal axis of the wheels 92 and also to pivot about a vertical axis. The wheels 92 also allow translational movement of the mechanical arm.

Figure 8:
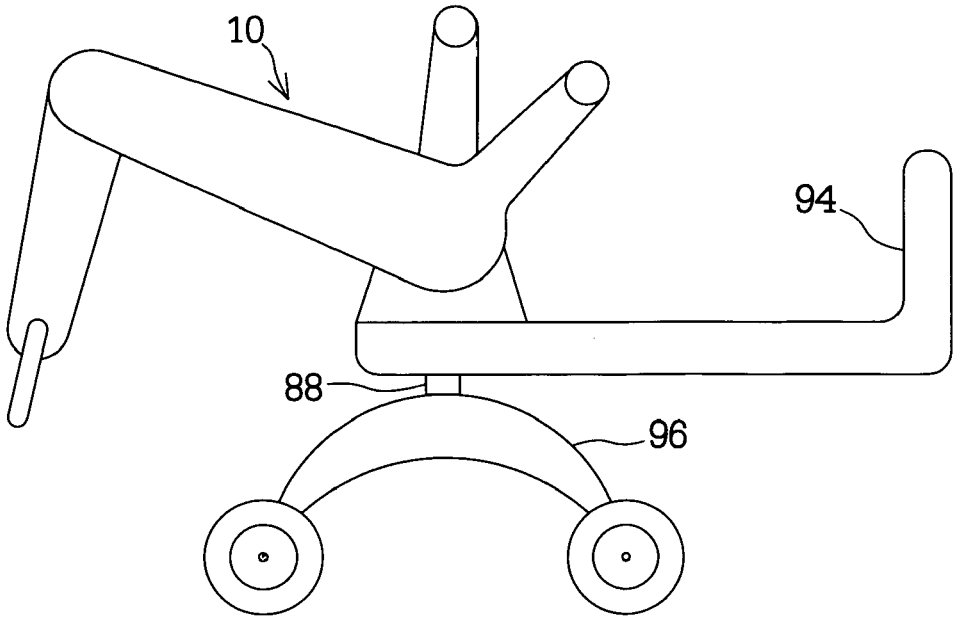
FIG. 8 shows the mechanical arm mounted to a wheeled support means having a seat for the operator.

An additional embodiment shown in FIG. 8, includes the mechanical arm mounted to a wheeled toy 96 with a seat 94 for the operator.

Figure 9:
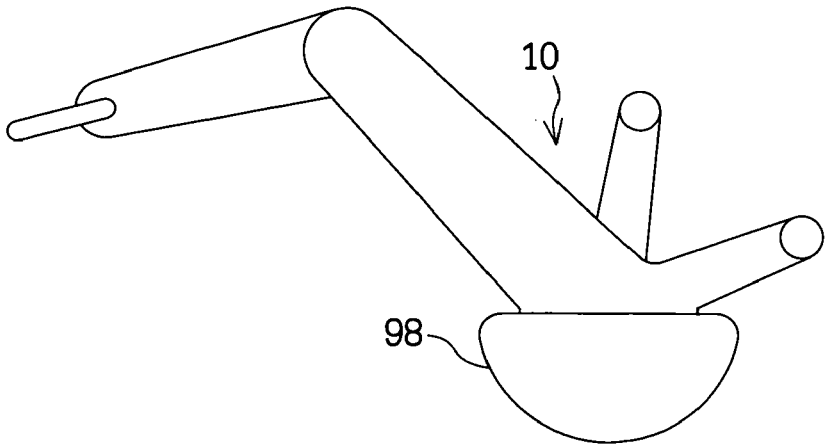
FIG. 9 shows the mechanical arm mounted to a support means having a hemispherical base.

As illustrated in FIG. 9, an additional embodiment includes a hemispherical base 98 mounted to the arm assembly 20 in place of the turret 22, the base 24, and the base pivot joint 88 to allow an additional degree of rotational freedom about a horizontal axis of the mechanical arm 10.

What is claimed is:

1. A mechanical arm comprising:

support means;

a first link and a second link, said first link having a proximal end and a distal end, said second link having a proximal end and a distal end;

said proximal end of said first link mounted to said support means;

said proximal end of said second link pivotally connected to said distal end of said first link for rotation relative thereto about a first pivot axis;

a first lever and a second lever, said first lever having a proximal end and a distal end, said second lever having a proximal end and a distal end;

an arm assembly comprising said first lever, said second lever, said first link, wherein said distal end of said first lever rigidly connected to said proximal end of said first link, said distal end of said second lever pivotally connected to said proximal end of said first link for rotation relative thereto about a second pivot axis parallel to said first pivot axis;

a first shaft having a first end and a second end, wherein said first end being rigidly connected to said proximal end of said second link, a first pulley concentrically fixed to said second end of said first shaft, said second end of said first shaft being pivotally connected to said distal end of said first link for rotation relative thereto about said first pivot axis;

a second shaft having a first end and a second end, wherein said first end being rigidly connected to said distal end of said second lever, a second pulley concentrically fixed to said second end of said second shaft, said second end of said second shaft being pivotally connected to said proximal end of said first link for rotation relative thereto about said second pivot axis;

a flexible mechanical element coupling said first pulley and said second pulley;

a manually actuable end effector connected to said distal end of said second link.

2. The mechanical arm of claim 1, wherein the support means has multiple degrees of freedom.

3. The mechanical arm of claim 1, further comprising a first handgrip having a longitudinal axis, wherein said first handgrip rigidly connected to said proximal end of said first lever, said longitudinal axis being parallel to said first pivot axis.

4. The mechanical arm of claim 1, further comprising a handgrip having a longitudinal axis, wherein said handgrip rigidly connected to said proximal end of said second lever, said longitudinal axis being parallel to said first pivot axis.

5. The mechanical arm of claim 1, wherein said first shaft, said second shaft, said first link, said second link, said second lever are generally hollow forming an interiorly open space.

6. The mechanical arm of claim 5, wherein said flexible mechanical element crossing upon itself while traversing said interiorly open space between said first pulley and said second pulley.

7. The mechanical arm of claim 5, further comprising an end effector lever and an end effector cable having a first end and a second end, said end effector lever slidably attached to said proximal end of said second lever, said end effector cable extending through said interiorly open space of said second lever, said first link, said second link, said first shaft, and said second shaft, said first end of said end effector cable connected to said end effector lever, said second end of said end effector cable connected to said end effector.

8. The mechanical arm of claim 1, wherein said flexible mechanical element comprises a drive cable.

9. A mechanical arm comprising:

a first link and a second link, said first link having a proximal end and a distal end, said second link having a proximal end and a distal end;

said proximal end of said second link pivotally connected to said distal end of said first link for rotation relative thereto about a first pivot axis;

a first lever and a second lever, said first lever having a proximal end and a distal end, said second lever having a proximal end and a distal end;

an arm assembly comprising said first lever, said second lever, said first link, wherein said distal end of said first lever rigidly connected to said proximal end of said first link, said distal end of said second lever pivotally connected to said proximal end of said first link for rotation relative thereto about a second pivot axis parallel to said first pivot axis;

a first shaft having a first end and a second end, wherein said first end being rigidly connected to said proxinial end of said second link, a first pulley concentrically fixed to said second end of said first shaft, said second end of said first shaft being pivotally connected to said distal end of said first link for rotation relative thereto about said first pivot axis;

a second shaft having a first end and a second end, wherein said first end being rigidly connected to said distal end of said second lever, a second pulley concentrically fixed to said second end of said second shaft, said second end of said second shaft being pivotally connected to said proximal end of said first link for rotation relative thereto about said second pivot axis;

a flexible mechanical element coupling said first pulley and said second pulley.

10. The mechanical arm of claim 9, further comprises a support means mounted to said proximal end of said first link.

11. The mechanical arm of claim 10, wherein said support means has multiple degrees of freedom.

12. The mechanical arm of claim 9, further comprises a manually actuable end effector connected to said distal end of said second link.

13. The mechanical arm of claim 9, further comprising a first handgrip having a longitudinal axis, wherein said first handgrip rigidly connected to said proximal end of said first lever, said longitudinal axis being parallel to said first pivot axis.

14. The mechanical arm of claim 9, further comprising a handgrip having a longitudinal axis, wherein said handgrip rigidly connected to said proximal end of said second lever, said longitudinal axis being parallel to said first pivot axis.

15. The mechanical arm of claim 9, wherein said first shaft, said second shaft, said first link, said second link, said second lever are generally hollow forming an interiorly open space.

16. The mechanical arm of claim 15, wherein said flexible mechanical element crossing upon itself while traversing said interiorly open space between said first pulley and said second pulley.

17. The mechanical arm of claim 9, wherein said flexible mechanical element comprises a drive cable.

18. The mechanical arm of claim 15, further comprising an end effector lever and an end effector cable having a first end and a second end, said end effector lever slidably attached to said proximal end of said second lever, said end effector cable extending though said interiorly open space of said second lever, said first link, said second link, said first shaft, and said second shaft, said first end of said end effector cable connected to said end effector lever, said second end of said end effector cable connected to said end effector.

* * * * *